US008091482B2

(12) United States Patent
Rotkopf

(10) Patent No.: US 8,091,482 B2
(45) Date of Patent: Jan. 10, 2012

(54) WARHEAD FOR INTERCEPTING SYSTEM

(75) Inventor: Menachem Rotkopf, Haifa (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 374 days.

(21) Appl. No.: 12/514,456

(22) PCT Filed: Nov. 4, 2007

(86) PCT No.: PCT/IL2007/001342

§ 371 (c)(1),
(2), (4) Date: May 12, 2009

(87) PCT Pub. No.: WO2008/059477

PCT Pub. Date: May 22, 2008

(65) Prior Publication Data

US 2009/0288573 A1 Nov. 26, 2009

(30) Foreign Application Priority Data

Nov. 13, 2006 (IL) ..... 179224

(51) Int. Cl.
*F42B 12/10* (2006.01)

(52) U.S. Cl. ..... 102/475; 102/489; 102/400; 102/476

(58) Field of Classification Search ..... 102/493, 102/497, 492, 475, 480, 489, 476, 494, 495, 102/400

See application file for complete search history.

(56) References Cited

U.S. PATENT DOCUMENTS

| | | | | |
|---|---|---|---|---|
| 3,613,586 | A | 10/1971 | Talley et al. | |
| 3,712,229 | A * | 1/1973 | Schock | 102/489 |
| 3,797,391 | A | 3/1974 | Cammarata et al. | |
| 3,949,674 | A | 4/1976 | Talley | |
| 4,004,518 | A | 1/1977 | Potteiger et al. | |
| 6,021,716 | A * | 2/2000 | Taylor | 102/517 |
| 6,619,210 | B1 | 9/2003 | Spivak et al. | |
| 6,910,423 | B2 * | 6/2005 | Lloyd | 102/497 |
| 6,920,827 | B2 * | 7/2005 | Llyod | 102/497 |
| 6,931,994 | B2 * | 8/2005 | Lloyd | 102/489 |
| 7,007,607 | B1 | 3/2006 | Fong et al. | |
| 7,104,496 | B2 * | 9/2006 | Chang | 244/3.19 |
| 7,614,348 | B2 * | 11/2009 | Truitt et al. | 102/491 |
| 2003/0172832 | A1 * | 9/2003 | O'Dwyer | 102/475 |
| 2006/0065150 | A1 * | 3/2006 | O'Dwyer | 102/489 |
| 2006/0086279 | A1 * | 4/2006 | Lloyd | 102/497 |
| 2007/0084376 | A1 | 4/2007 | Lloyd | |
| 2009/0205529 | A1 * | 8/2009 | Lloyd | 102/476 |
| 2010/0162915 | A1 * | 7/2010 | Rastegar | 102/400 |

OTHER PUBLICATIONS

Bender et al., "Explosively Formed Projectiles" in Tactical Missile Warhead, Progress in Astronautics and Aeronautics, vol. 155, Chapter 7, pp. 367-375, 1993.

* cited by examiner

*Primary Examiner* — Michael Carone
*Assistant Examiner* — Joshua Freeman
(74) *Attorney, Agent, or Firm* — Mark M. Friedman

(57) ABSTRACT

A warhead system for a projectile-intercepting munition, the warhead system includes a fuselage having an axis and one or more explosively-formed-projectile charge. The explosively-formed-projectile is with a length and configured to generate one or more explosively formed blade projectile propagating substantially perpendicular to the length, the explosively-formed-projectile charge assuming a deployed state wherein the length of the explosively-formed-projectile charge is non-parallel to the axis, the deployed state and the explosively-formed-projectile charge configured such that, when the explosively-formed-projectile charge is detonated in the deployed state, the explosively formed blade projectile propagates in a direction non-coplanar with the length of the explosively-formed-projectile charge and the axis of the fuselage.

16 Claims, 6 Drawing Sheets

WARHEAD FOR INTERCEPTING SYSTEM

RELATED APPLICATIONS

This patent application is a U.S. National Phase Application of PCT/IL2007/001342 filed on Nov. 4, 2007, and also claims the benefit of IL 179224 filed Nov. 13, 2006 the contents of which are incorporated herein by reference.

FIELD AND BACKGROUND OF THE INVENTION

The present invention relates to active defense systems and, in particular, it concerns a warhead system for a projectile-intercepting munition.

An "explosively formed projectile" (EFP) munition is an explosive charge with a metallic liner configured such that, when the explosive charge is detonated, the explosion creates enormous pressures that accelerate the liner while simultaneously reshaping the liner into a rod, blade or some other desired shape. For more details on EFP munitions, see D. Bender and J. Carleone, "Explosively formed projectiles", in *Tactical Missile Warheads* (Progress in Astronautics and Aeronautics, Vol. 155, Chapter 7, pp. 367-375, 1993).

Fong et al., in U.S. Pat. No. 7,007,607, teach a missile that deploys EFP munitions to breach a reinforced concrete wall. This patent is incorporated by reference for all purposes as if fully set forth herein.

The last few decades have seen large-scale proliferation of unguided short-range artillery rockets and short-range surface-to-surface rockets. One of the most widespread examples is the Russian BM-21 Grad, and its variants and equivalents. These rockets are relatively slow (typically subsonic) and not particularly accurate, but their low cost and simple deployment make them an attractive option for mass deployment and for low-tech armed forces, militias and criminal or terrorist groups.

It would be highly desirable to provide an active defense system for defeating such rockets before they reach their intended target. However, given the nature of the threat, any such active defense system would need to be sufficiently low cost to allow widespread deployment and to render its use economically viable.

The approach used by larger systems designed for intercepting medium-range or long-range ballistic missiles is not readily scaled down for application to short range rockets of the types described above. Specifically, the relatively low velocity of the target rocket itself renders collision with small low velocity particles ineffective to defeat the rocket. Instead, a high velocity impact is required to reliably defeat the rocket. Although such a high velocity impact could in principle be produced by a fragmentation warhead, classical fragmentation warheads of suitable dimensions are typically not sufficient. If relatively large fragments (of the order of grams) were used, the number density of the fragments would drop off very rapidly with miss-distance, resulting in a low probability of impinging on the rocket. Increasing the number of large fragments would result in a warhead too large and costly to be suitable for the intended function. If smaller fragments (of the order of tenths of a gram) were used, these would typically be ineffective for defeating the rocket.

There is thus a need for, and it would be highly advantageous to have, a munition system for intercepting short-range artillery or surface-to-surface rockets. In particular, it would be advantageous to provide a warhead system for such a projectile-intercepting munition which would be more effective than standard fragmentation warheads.

SUMMARY OF THE INVENTION

The present invention is a warhead system for a projectile-intercepting munition.

According to the teachings of the present invention there is provided, a warhead system for a projectile-intercepting munition, the warhead system comprising: (a) a fuselage having an axis; and (b) at least one explosively-formed-projectile charge having a length and configured to generate at least one explosively formed blade projectile propagating substantially perpendicular to the length, the at least one explosively-formed-projectile charge assuming a deployed state wherein the length of the at least one explosively-formed-projectile charge is non-parallel to the axis, the deployed state and the explosively-formed-projectile charge being configured such that, when the explosively-formed-projectile charge is detonated in the deployed state, the explosively formed blade projectile propagates in a direction non-coplanar with the length of the explosively-formed-projectile charge and the axis of the fuselage.

There is also provided according to the teachings of the present invention, a warhead system for a projectile-intercepting munition, the warhead system comprising: (a) a fuselage having an axis; and (b) at least one explosively-formed-projectile charge having a length and configured to generate at least one explosively formed blade projectile propagating substantially perpendicular to the length, the at least one explosively-formed-projectile charge assuming a deployed state wherein the length of the at least one explosively-formed-projectile charge is non-parallel to the axis, the deployed state and the explosively-formed-projectile charge being configured such that, when the explosively-formed-projectile charge is detonated in the deployed state, the explosively formed blade projectile propagates in a direction forming an angle of between 80 degrees and 180 degrees with a forward direction of the fuselage along the axis.

There is also provided according to the teachings of the present invention, a warhead system for a projectile-intercepting munition, the warhead system comprising: (a) a fuselage having an axis; (b) at least two explosively-formed-projectile charges, each having a length and configured to generate at least one explosively formed blade projectile propagating substantially perpendicular to the length, the explosively-formed-projectile charges being deployable between a stowed state in which the length lies substantially parallel with the axis of the fuselage and a deployed state wherein the length of each of the explosively-formed-projectile charges is non-parallel to the axis; and (c) a detonation system configured to allow selective detonation of a first of the explosively-formed-projectile charges without detonation of a second of the explosively-formed-projectile charges.

According to a further feature of the present invention, there is also provided at least one sensor deployed for sensing a position of a target projectile, the detonation system being responsive to a sensed position of the target projectile to selectively detonate a subset of the explosively-formed-projectile charges that are deployed to form the explosively formed blade projectile propagating towards the sensed position.

There is also provided according to the teachings of the present invention, a warhead system for a projectile-intercepting munition, the warhead system comprising: (a) a fuselage having an axis; (b) at least two explosively-formed-projectile charges, each having a length and configured to generate at least one explosively formed blade projectile propagating substantially perpendicular to the length, the explosively-formed-projectile charges being deployable between a stowed state in which the length lies substantially parallel with the axis of the fuselage and a deployed state wherein the length of each of the explosively-formed-projectile charges is non-parallel to the axis; and (c) a deployment mechanism configured to allow deployment of a first of the explosively-formed-projectile charges to a deployed position at a first angle relative to the axis and deployment of a second of the explosively-formed-projectile charges to a deployed position at a second angle relative to the axis, the second angle being different from the first angle.

According to a further feature of the present invention, there is also provided at least one sensor deployed for sensing a position of a target projectile, the deployment mechanism being responsive to a sensed position of the target projectile to select an opening angle for at least one of the explosively-formed-projectile charges.

There is also provided according to the teachings of the present invention, a warhead system for a projectile-intercepting munition, the warhead system comprising: (a) a fuselage having an axis; and (b) at least one explosively-formed-projectile charge having a length and configured to generate at least two explosively formed blade projectiles propagating substantially perpendicular to the length, the at least one explosively-formed-projectile charge assuming a deployed state wherein the length of the at least one explosively-formed-projectile charge is non-parallel to the axis.

According to a further feature of the present invention, each the explosively-formed-projectile charge is operative, when detonated, to emit between two and six of the blade projectiles propagating substantially perpendicular to the length.

According to a further feature of the present invention, there is also provided a control system including: a detonation subsystem for detonating the at least one explosively-formed-projectile charge; and a sensor configured for sensing a location of the warhead system relative to a target, the control system being configured to detonate the at least one explosively-formed-projectile charge in accordance with the location.

According to a further feature of the present invention, the control system is further configured to derive a velocity of the warhead system relative to the target, the mechanism being operative to detonate the at least one explosively-formed-projectile charge in accordance with both the location and the velocity.

According to a further feature of the present invention, each the explosively-formed-projectile charge is hingedly attached to the fuselage.

According to a further feature of the present invention, each the explosively-formed-projectile charge is rigidly attached to the fuselage.

There is also provided according to the teachings of the present invention, a method for defeating a short-range surface-to-surface projectile, the method comprising the steps of: (a) estimating a trajectory of the projectile; (b) firing a projectile-intercepting munition on an intercepting flight path so as to bring the projectile-intercepting munition within an engagement distance from the projectile, the projectile carrying a warhead system including a charge; and (c) detonating the charge so as to defeat the projectile, wherein the charge is an explosively-formed-projectile charge having a length and configured to generate at least one explosively formed blade projectile propagating substantially perpendicular to the length.

According to a further feature of the present invention, the explosively-formed-projectile charge is configured to generate at least two explosively formed blade projectile propagating substantially perpendicular to the length.

According to a further feature of the present invention, the munition includes a fuselage having an axis, and wherein the explosively-formed-projectile charge assumes a deployed state in which the length of the explosively-formed-projectile charge is non-parallel to the axis, the deployed state and the explosively-formed-projectile charge being configured such that, when the explosively-formed-projectile charge is detonated in the deployed state, the explosively formed blade projectile propagates in a direction non-coplanar with the length of the explosively-formed-projectile charge and the axis of the fuselage.

According to a further feature of the present invention, the munition includes a fuselage having an axis, and wherein the explosively-formed-projectile charge assumes a deployed state in which the length of the explosively-formed-projectile charge is non-parallel to the axis, the deployed state and the explosively-formed-projectile charge being configured such that, when the explosively-formed-projectile charge is detonated in the deployed state, the explosively formed blade projectile propagates in a direction forming an angle of between 80 degrees and 180 degrees with a forward direction of the fuselage along the axis.

According to a further feature of the present invention, the warhead system includes at least a first and a second explosively-formed-projectile charge, and wherein the warhead system is configured to allow selective detonation of a first of the explosively-formed-projectile charges without detonation of a second of the explosively-formed-projectile charges.

According to a further feature of the present invention, the munition includes a fuselage having an axis, wherein the projectile-intercepting munition further including a deployment mechanism configured to allow selective deployment of the explosively-formed-projectile charge to a deployed position at each of a plurality of different angles relative to the axis, the method further comprising activating the deployment mechanism so as to deploy the explosively-formed-projectile charge for directing the explosively formed blade projectile towards the projectile.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a warhead system for a projectile-intercepting munition.

The principles and operation of warhead systems according to the present invention may be better understood with reference to the drawings and the accompanying description.

By way of introduction, the present invention addresses the shortcomings of conventional fragmentation warheads to defeat projectiles by employing explosively-formed-projectile charges configured to form an explosively formed slug elongated in a direction perpendicular to its direction of travel. Such a slug is highly effective over relatively large distances to cut through objects in its way, and is therefore referred to herein functionally as an "explosively formed blade projectile". The actual cross-sectional shape of the slug may vary considerable, as a function of the charge shape and liner thickness, as is known to one ordinarily skilled in the art. Examples of cross-sectional shapes of the blade projectile include, but are not limited to: round; V-shaped and wedge-shaped. An example of one suitable charge configuration is that described in the aforementioned U.S. Pat. No. 7,007,607.

Thus, in general terms, the present invention provides a method for defeating a short-range surface-to-surface rocket or other short-range projectile in which a trajectory of the rocket is estimated, a projectile-intercepting munition is fired on an intercepting flight path so as to bring the projectile-intercepting munition within an engagement distance from the rocket, and at least one charge of a warhead system carried by the munition is detonated so as to defeat the rocket. It is a particular feature of the present invention that the at least one charge is an explosively-formed-projectile charge having a length and configured to generate at least one explosively formed blade projectile traveling substantially perpendicular to the length of the charge.

In most preferred implementations of the invention, one or more of a number of features are preferably adopted in order to further enhance the likelihood of defeating the target. These features can be broadly subdivided into two groups: a first group of features which increase the spatial coverage of explosively formed blades emitted around the munition; and a second group of features which provide various levels of selective "aiming" of one or more explosively formed blades towards the target. Unless otherwise stated or self-evident, it should be understood that the various different features are not mutually exclusive, and may be used to advantage together.

Figure 1A:
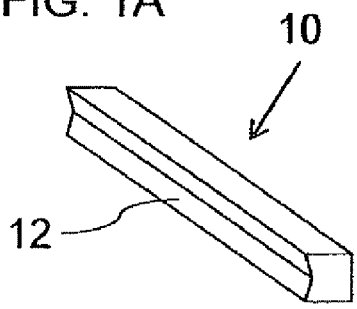
FIG. 1A is a schematic isometric view of a first implementation of an explosively-formed-projectile charge for use in a warhead system, constructed and operative according to the teachings of the present invention, for a projectile-intercepting munition.
Figure 1B:
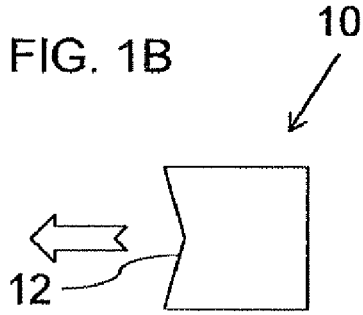
FIG. 1B is a schematic cross-sectional view taken through the charge of FIG. 1A and illustrating the direction of travel of a single explosively formed projectile emitted by this charge.
Figure 2A:
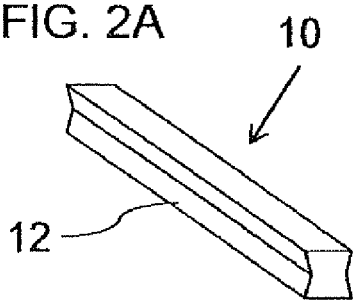
FIG. 2A is a schematic isometric view of a second implementation of an explosively-formed-projectile charge for use in a warhead system, constructed and operative according to the teachings of the present invention, for a projectile-intercepting munition.
Figure 2B:
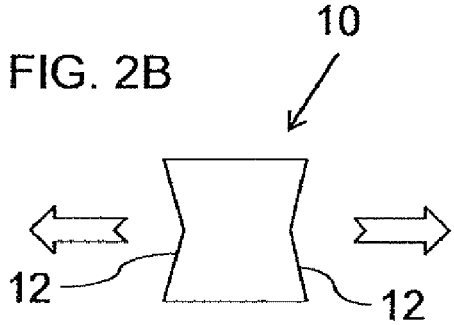
FIG. 2B is a schematic cross-sectional view taken through the charge of FIG. 2A and illustrating the direction of travel of two explosively formed projectiles emitted by this charge.
Figure 3A:
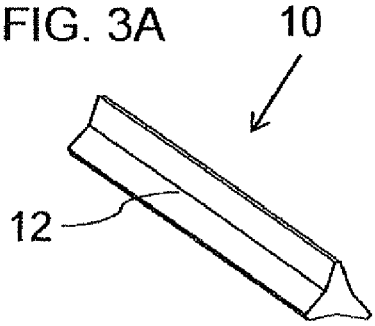
FIG. 3A is a schematic isometric view of a third implementation of an explosively-formed-projectile charge for use in a warhead system, constructed and operative according to the teachings of the present invention, for a projectile-intercepting munition.
Figure 3B:
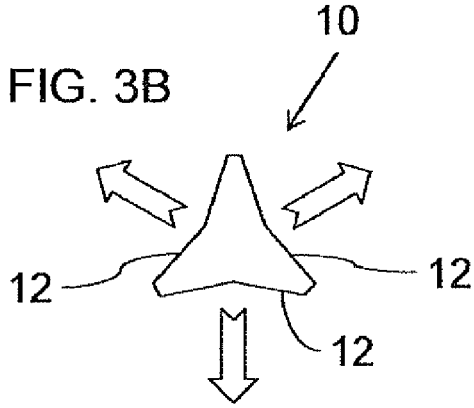
FIG. 3B is a schematic cross-sectional view taken through the charge of FIG. 3A and illustrating the direction of travel of three explosively formed projectiles emitted by this charge.
Figure 4A:
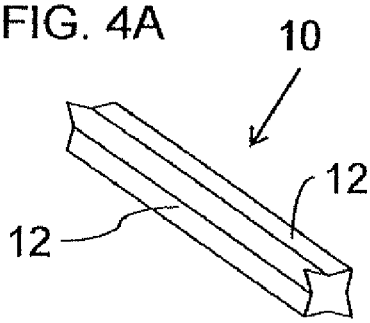
FIG. 4A is a schematic isometric view of a fourth implementation of an explosively-formed-projectile charge for use in a warhead system, constructed and operative according to the teachings of the present invention, for a projectile-intercepting munition.
Figure 4B:
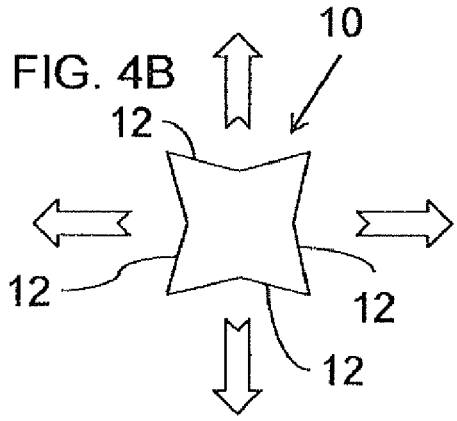
FIG. 4B is a schematic cross-sectional view taken through the charge of FIG. 4A and illustrating the direction of travel of four explosively formed projectiles emitted by this charge.
Figure 5A:
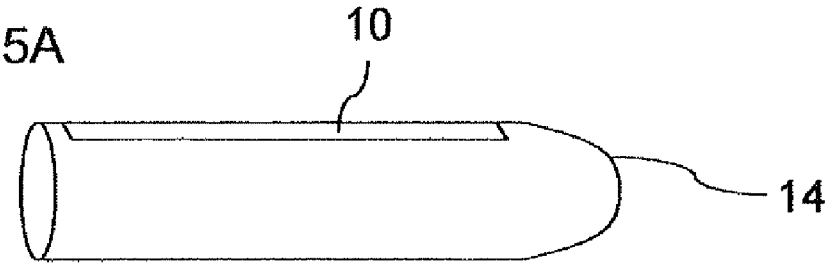
FIGS. 5A-5D are schematic isometric views of a projectile carrying a first embodiment of a warhead system, constructed and operative according to the teachings of the present invention, including a single charge, the warhead being shown, respectively, in a stowed state, and in three deployed states at different opening angles.
Figure 5B:
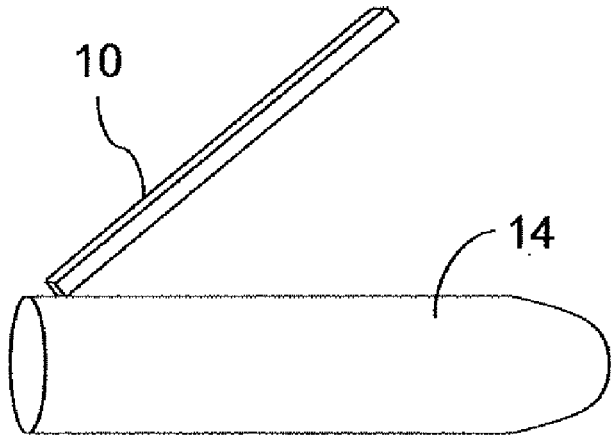
Figure 5C:
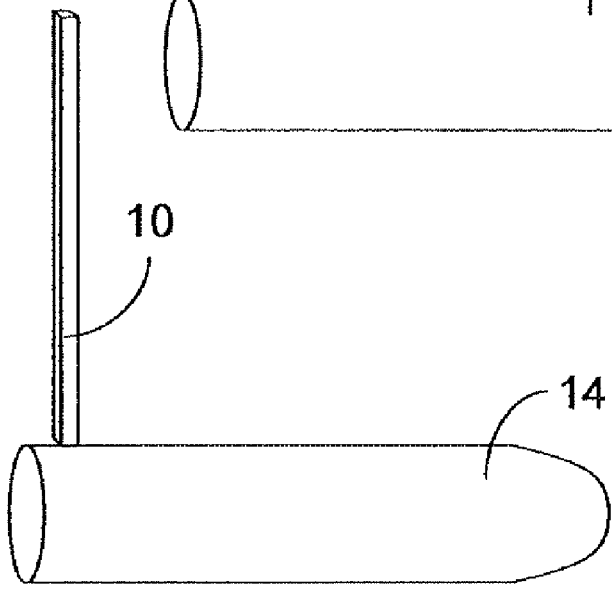
Figure 5D:
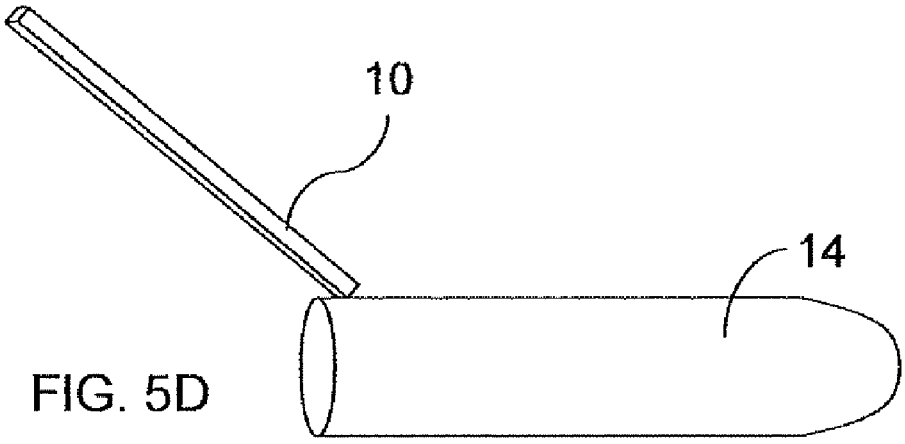

Turning now to the Figures, FIGS. 1A and 1B illustrate a basic implementation of an explosively-formed-projectile charge 10 configured for emitting an explosively formed blade. Charge 10 has an elongated low-angle recess 12 lined with suitably ductile metallic liner material so that, on detonation of the charge, a major part of the liner material is formed into an explosively formed blade extending in a direction parallel to the length of the charge and traveling in a direction perpendicular to the length, as indicated by the arrow in FIG. 1B.

In most preferred implementations, as exemplified in FIGS. 2A-4B, each explosively-formed-projectile charge is configured to generate a plurality of explosively formed blade projectiles propagating substantially perpendicular to the length. Thus, in the example of FIGS. 2A and 2B, the charge is configured to generate two blade projectiles emitted in opposite directions. Similarly, FIGS. 3A-3B and 4A-4B show examples of charges configured to generate three and four blade projectiles, respectively. Larger numbers of blades are also possible, although more than six per charge are typically not required. Preferably, although not necessarily, the charges are configured to emit the blade projectiles in symmetrically distributed directions of travel, as illustrated here. It will be immediately appreciated that the use of a plurality of blade projectiles per charge increases the number of directions in which projectiles are emitted, thereby increasing the spatial coverage around the munition. Typically, the weight of each charge lies in the range from 0.05 kg up to 10 kg, and most preferably in the range from 0.2 kg up to 2 kg. The resulting blade projectile typically has a weight in the range of 10-20 percent of the charge weight.

Turning now to FIGS. 5A-5D, a warhead system including one or more charge 10 is carried to intercept the target projectile by a fuselage 14. Details of fuselage 14 per se are not part of the present invention, which can be implemented using substantially any type of passive projectile, rocket, missile, UAV or other platform which is effective to bring the warhead system to an intercept position within an effective range of the target projectile. In one set of applications, a number of charges 10 are rigidly mounted on fuselage 14. This option is particularly suited to very short range applications, such as protecting tanks or other vehicles from anti-tank rockets or RPGs. For other applications, charges 10 are preferably deployed in a stowed state (FIG. 5A), with their length substantially parallel with the axis of fuselage 14, during flight, thereby minimizing drag. The charges are then moved to a deployed state (FIGS. 5B, 5C and/or 5D), non-parallel to the fuselage axis, prior to detonation.

Deployment of charges 10 from their stowed positions to the deployed position may be achieved in any desired manner. According to a particularly preferred option, each charge 10 is hingedly attached to fuselage 14, typically at its rearmost end. The deployed state of each charge 10 may be at a fixed predefined angle to the axis of the fuselage. According to this option, a deployment mechanism may be implemented simply as a spring-biased mechanism, an electromagnetic mechanism, or a pyrotechnically-actuated mechanism, with a simple mechanical stop at the appropriate angle. The open angles may be the same for each charge, as in the example of FIG. 6A-6B below, or may be different for different charges, as in the example of FIG. 7 below.

Figure 10A:
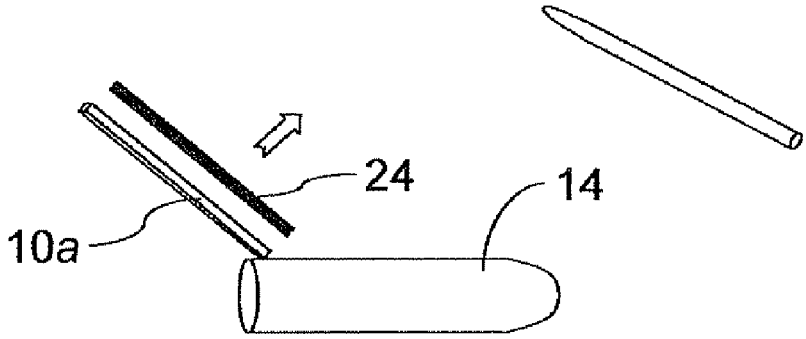
FIGS. 10A-10C are schematic illustrations showing particularly advantageous charge types and opening angles for neutralizing a rocket threat in cases of late arrival to intercept, accurate intercept, and early arrival to intercept, respectively.
Figure 10B:
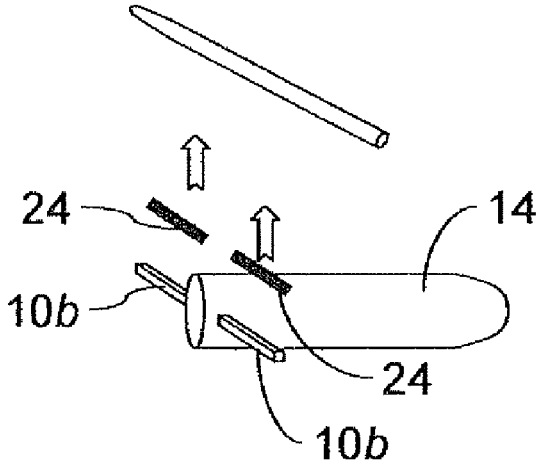
Figure 10C:
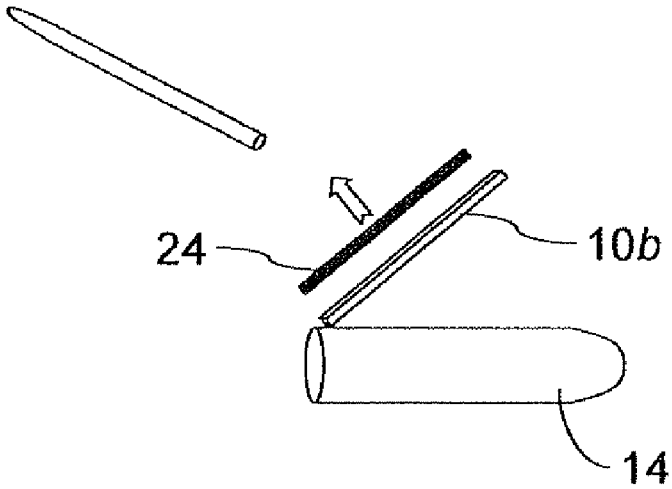

According to a further set of preferred implementations, each charge 10 may be controllably deployable to an angle relative to the fuselage which is chosen according to the particular parameters of the interception of the munition with the target rocket. This approach is best illustrated in FIGS. 10A-10C. Specifically, in FIG. 10A is illustrated a case where the target rocket is ahead of fuselage 14. This situation may arise where the munition is late to arrive at the point of closest interception of the target, or just prior to reaching the point of closest interception. In this situation, optimal chances of defeating the target missile may be achieved by a forward-directed explosively formed blade projectile emitted by a charge 10*a* opened to an angle greater than 90°, such as for example in the range of 105°-165°, relative to the forward axial direction of the fuselage.

FIG. 10B illustrates a case where the munition passes side-on to the target rocket. In this case, laterally directed blade projectiles directed at roughly 90° to the fuselage axis are most effective. The opening angle of the charges 10*b* in this case is typically not critical, but in the preferred case illustrated here, an opening angle of roughly 90° is used. Alternatively, they may be opened so as to deploy the length of the charges substantially perpendicular to the length of the target rocket.

FIG. 10C illustrates a case where the munition is ahead of the target rocket. This situation may arise where the munition is early to arrive at the point of closest interception of the target, or has just passed the point of closest interception. In this situation, optimal chances of defeating the target missile may be achieved by a rearward-directed explosively formed blade projectile emitted by a charge 10*c* opened to an angle less than 90°, such as for example in the range of 15°-75°, relative to the forward axial direction of the fuselage. Alternatively, a similar effect can be achieved by opening of a charge on the opposite (lower) side of projectile 14 to an angle greater than 90°, similar to the lower arm illustrated in FIG. 7. In either case, it will be appreciated that the use of a charge configured to emit a blade projectile in a sideways or rearward direction facilitates firing of an explosively formed blade projectile in a direction far from the "forward" direction of the fuselage, and most preferably, in a direction forming an angle of between 80 degrees and 180 degrees with a forward direction of the fuselage along the axis.

Figure 9:
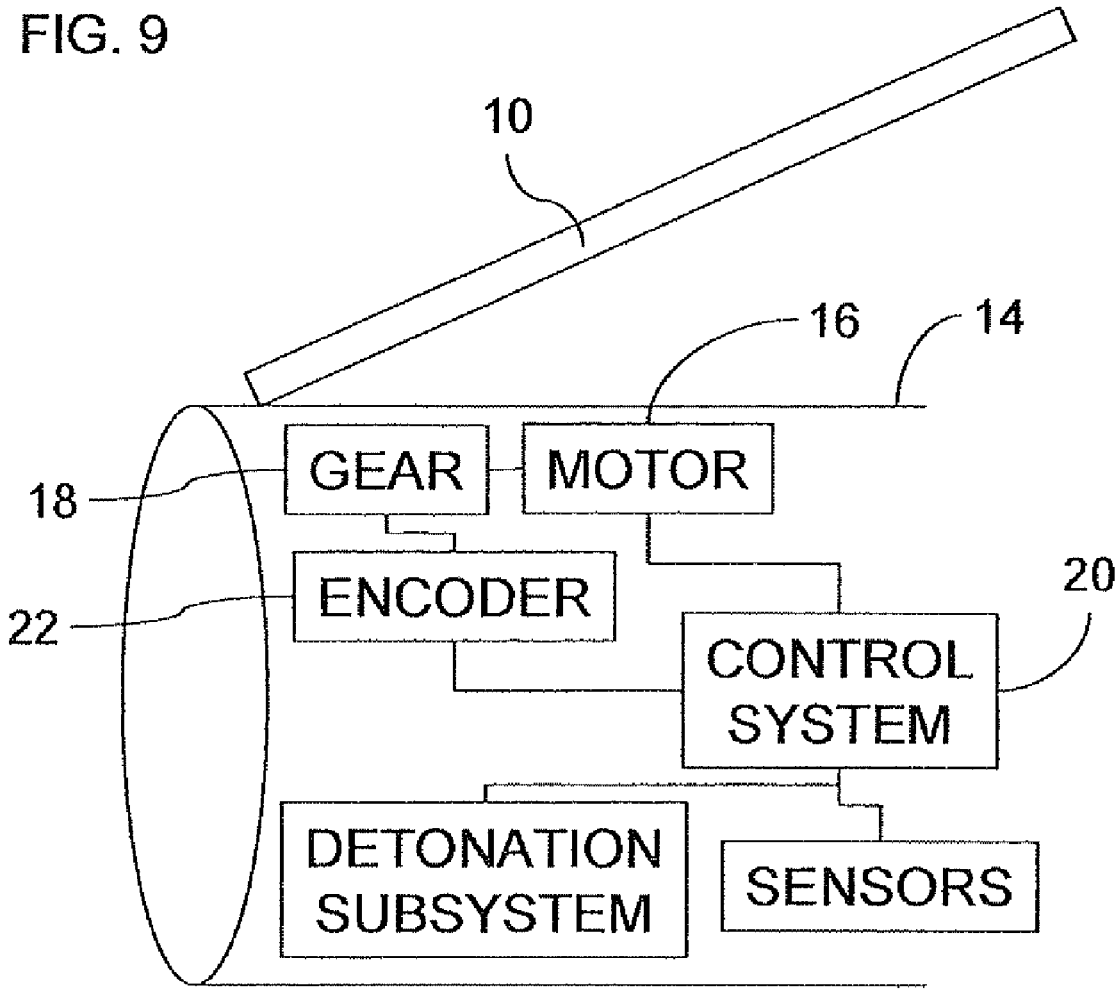
FIG. 9 is a schematic illustration of a part of a warhead system, constructed and operative according to the teachings of the present invention, showing a mechanism for controlling an angle of opening of a charge.

An example of a mechanism for achieving controlled selective opening of one or more charge 10 is illustrated schematically in FIG. 9. As shown here, each charge 10 is implemented as an arm rotated about its hinge by the action of a small electrical motor 16 connected to the arm by an appropriate gear system 18. The action of the motor is controlled by a control system 20, preferably operating under closed-loop control based on actual measurement of the arm rotation as indicated by an angular encoder 22 installed at the hinge. The gear system provides the necessary mechanical locking effect once the commanded angle is achieved. Optionally, all of the charges 10 may be moved together by a common deployment mechanism to the same opening angle. Alternatively, each charge/arm 10 may have its own independent deployment mechanism, allowing each charge to be optimally aimed towards the target rocket according to the parameters of interception (position and velocity of the target relative to the munition fuselage) as sensed by onboard or external sensor systems.

Figure 6A:
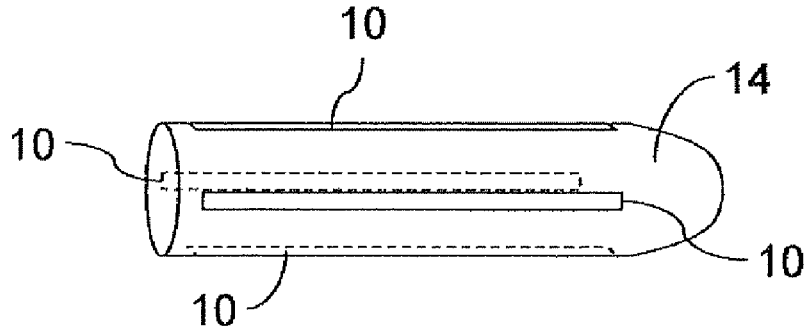
FIGS. 6A and 6B are schematic isometric views of a projectile carrying a second embodiment of a warhead system, constructed and operative according to the teachings of the present invention, including four charges, the warhead system being shown, respectively, in a stowed state and a deployed state.
Figure 6B:
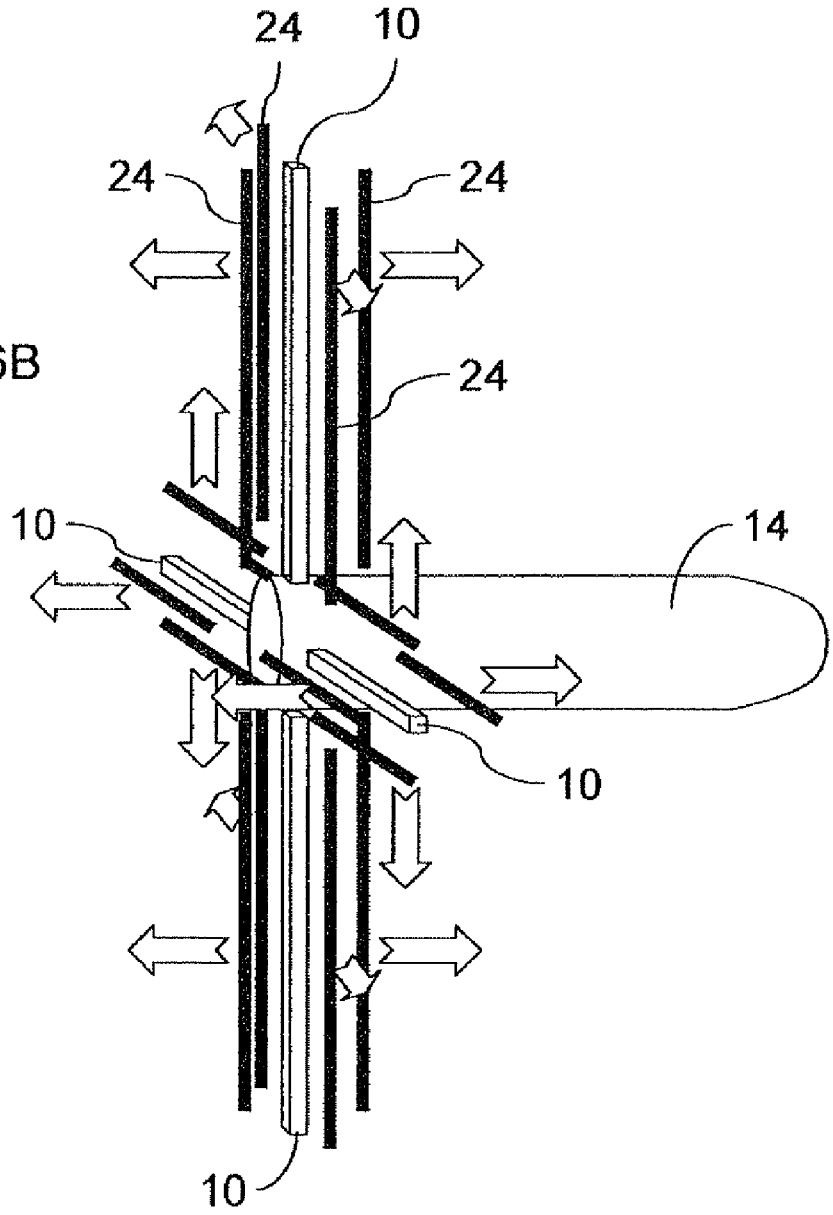

Turning now to a small number of exemplary embodiments of the present invention in more detail, FIGS. 6A and 6B illustrate a basic embodiment in which four charges 10, each configured to generate a plurality of explosively formed blade projectiles, are deployed on fuselage 14 via a deployment mechanism configured to open them on command to a predetermined angle, in this case about 90°, to the fuselage axis. The example shown here employs four charges each generating four blade projectiles, thereby producing a total of 16 blade projectiles 24 as illustrated in FIG. 6B. It will be appreciated that these blade projectiles provide extensive spatial coverage around fuselage 14, including towards the forward, rear, up, down, right and left directions relative to the fuselage forward axis (direction of travel). The up, down, left and right directions are achieved by blade projectiles emitted from the sides of the charges, i.e., in a direction non-coplanar with the length of the charge and the axis of the fuselage. According to the details of the intended application, the distribution of this spatial coverage can be varied, for example, by changing the opening angle of the arms to an angle other than 90°, and/or by rotating the orientation of one or more charge by 45° about its length.

It should be noted that, in this and other embodiments of the present invention, the various charges 10 are not necessarily detonated together. Specifically, according to certain preferred implementations of the present invention, the position and/or velocity of the target rocket relative to fuselage 14 is determined, and one or more selected charge 10 which has the best chances of defeating the target is detonated. Determination of the target position may be achieved autonomously by the munition via one or more onboard sensor (typically an optical sensor system), or may be performed via a remote command and control system in communication with the munition. Selective detonation of certain charges 10 may be particularly valuable to prevent interference of the less-effective charges' detonation with emission of blade projectiles from the better-placed charges.

Figure 7:
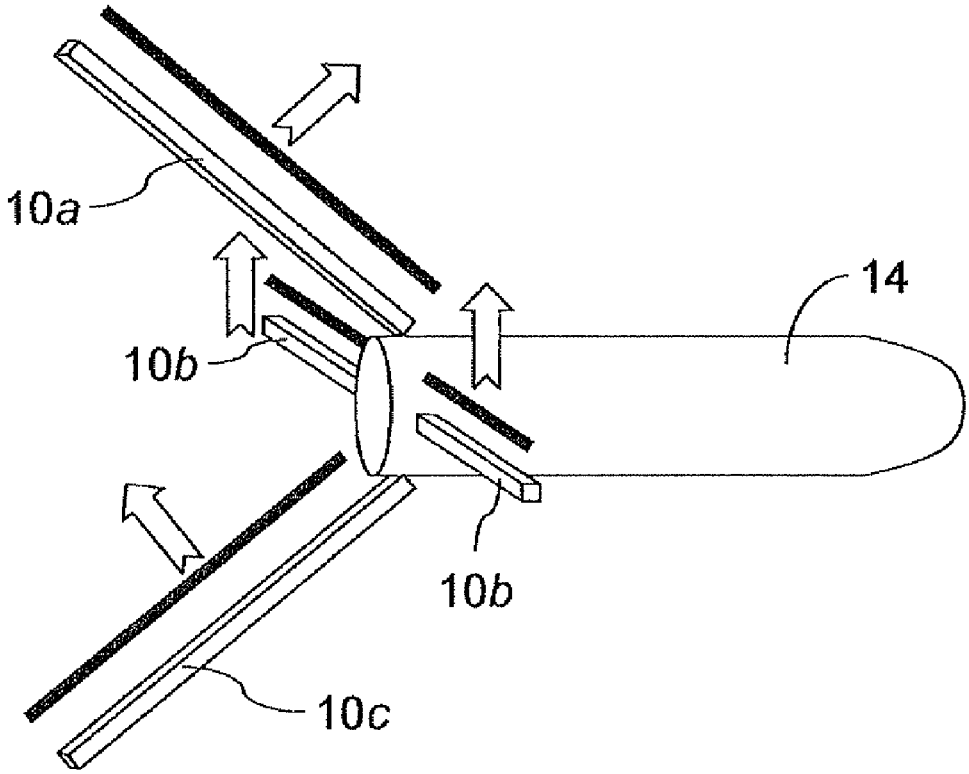
FIG. 7 is a schematic isometric view of a projectile carrying a third embodiment of a warhead system, constructed and operative according to the teachings of the present invention, including four charges in their deployed states, where different charges have different opening angles.

Turning now to FIG. 7, this illustrates an alternative approach according to which a single explosively formed blade per charge and fixed opening angles can still be used to achieve an aimed effect, particularly in the case of a roll-stabilized fuselage. In the configuration shown here, a first charge 10*a* is configured for generating a single forward-directed explosively formed blade projectile and has a deployment mechanism defining a swept-back deployed position, typically at an angle of in excess of 120° to the forward axis of fuselage 14. The two charges 10*b* are configured for generating a single upwardly-directed explosively formed blade projectile and have a deployment mechanism defining an outward deployed position typically at around 90° to the axis of fuselage 14. Here again, the blade projectiles are emitted in a direction non-coplanar with the length of the explosively-formed-projectile charge and the axis of the fuselage. Finally, a fourth charge 10*c* is configured for generating a single rearward-directed explosively formed blade projectile and has a deployment mechanism defining a swept-back deployed position, typically at an angle in excess of 120° to the forward axis of fuselage 14. It will be appreciated that, if these charges are all detonated, the result is a set of four blade projectiles all directed "upwards" in the orientation as shown, but encompassing directions perpendicularly upwards as well as slightly forwards and slightly backwards. When deployed on a roll-stabilized platform and combined with sensors, either onboard or remote, for sensing the position of the target rocket, it is possible to control the roll-attitude of the platform so that the "upwards" direction is facing towards the target rocket at or near the point of closest interception, thereby directing all of the blade projectiles towards the target.

Figure 8:
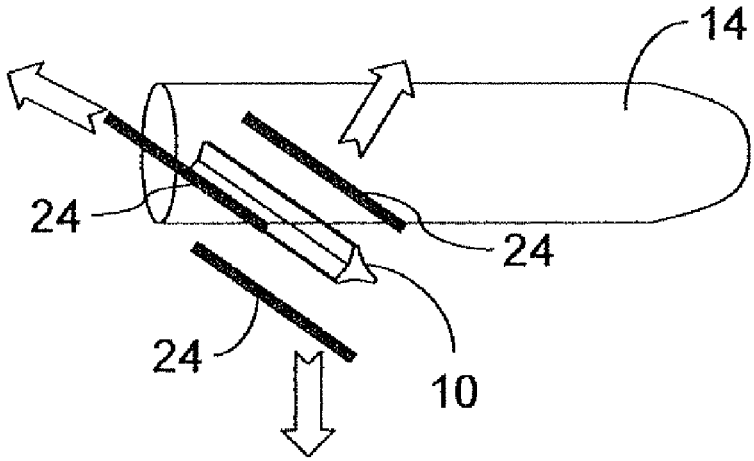
FIG. 8 is a schematic isometric view of a projectile carrying a warhead system, constructed and operative according to the teachings of the present invention, showing the directions of travel of explosively-formed-projectiles from a triangular-symmetry charge.

Turning now to FIG. 8, while the invention has been exemplified to this point primarily with reference to single blade projectiles or with rectangular symmetry, it will be noted that other geometries, such as the three-fold symmetry charge illustrated here, may also be used. In fact, particularly when combined with controlled opening angles of the arms, options such as triangular-symmetry implementations may provide an advantageously wide range of geometrical options to cover the space around the fuselage.

Amongst other applications, it should be noted that the warhead system of the present invention is in particular effective to actively defend objects such as various types of vehicles against incoming missile, rocket and projectile threats fired from a variety of platforms such as tanks, armored personnel carriers and helicopters, as well as by infantry.

It will be appreciated that the above descriptions are intended only to serve as examples, and that many other embodiments are possible within the scope of the present invention as defined in the appended claims.

What is clamied is:

1. A warhead system for a projectile-intercepting munition, the warhead system comprising:

(a) a fuselage having an axis; and (b) at least one explosively-formed-projectile charge having a length and configured to generate at least one explosively formed blade projectile propagating substantially perpendicular to said length, said at least one explosively-formed-projectile charge assuming a deployed state wherein said length of said at least one explosively-formed-projectile charge is non-parallel to said axis, said deployed state and said explosively-formed-projectile charge being configured such that, when said explosively-formed-projectile charge is detonated in said deployed state, said explosively formed blade projectile propagates in a direction non-coplanar with said length of said explosively-formed-projectile charge and said axis of said fuselage.

2. A warhead system for a projectile-intercepting munition, the warhead system comprising:

(a) a fuselage having an axis; and (b) at least one explosively-formed-projectile charge having a length and configured to generate at least one explosively formed blade projectile propagating substantially perpendicular to said length, said at least one explosively-formed-projectile charge assuming a deployed state wherein said length of said at least one explosively-formed-projectile charge is non-parallel to said axis, said deployed state and said explosively-formed-projectile charge being configured such that, when said explosively-formed-projectile charge is detonated in said deployed state, said explosively formed blade projectile propagates in a direction forming an angle of between 80 degrees and 180 degrees with a forward direction of said fuselage along said axis.

3. A warhead system for a projectile-intercepting munition, the warhead system comprising:

(a) a fuselage having an axis;

(b) at least two explosively-formed-projectile charges, each having a length and configured to generate at least one explosively formed blade projectile propagating substantially perpendicular to said length, said explosively-formed-projectile charges being deployable between a stowed state in which said length lies substantially parallel with said axis of said fuselage and a deployed state wherein said length of each of said explosively-formed-projectile charges is non-parallel to said axis; and (c) a deployment mechanism configured to allow deployment of a first of said explosively-formed-projectile charges to a deployed position at a first angle relative to said axis and deployment of a second of said explosively-formed-projectile charges to a deployed position at a second angle relative to said axis, said second angle being different from said first angle.

4. The warhead system of claim 3, further comprising at least one sensor deployed for sensing a position of a target projectile, said deployment mechanism being responsive to a sensed position of the target projectile to select an opening angle for at least one of said explosively-formed-projectile charges.

5. A warhead system for a projectile-intercepting munition, the warhead system comprising:

(a) a fuselage having an axis; and (b) at least one explosively-formed-projectile charge having a length and configured to generate at least two explosively formed blade projectiles propagating substantially perpendicular to said length, said at least one explosively-formed-projectile charge assuming a deployed state wherein said length of said at least one explosively-formed-projectile charge is non-parallel to said axis.

6. The warhead system of claim 5, wherein each said explosively-formed-projectile charge is operative, when detonated, to emit between two and six of said blade projectiles propagating substantially perpendicular to said length.

7. The warhead system of claim 5, further comprising a control system including: a detonation subsystem for detonating said at least one explosively-formed-projectile charge; and a sensor configured for sensing a location of the warhead system relative to a target, said control system being configured to detonate said at least one explosively-formed-projectile charge in accordance with said location.

8. The warhead system of claim 7, wherein said control system is further configured to derive a velocity of the warhead system relative to said target, the mechanism being operative to detonate said at least one explosively-formed-projectile charge in accordance with both said location and said velocity.

9. The warhead system of claim 5, wherein each said explosively-formed-projectile charge is hingedly attached to said fuselage.

10. The warhead system of claim 5, wherein each said explosively-formed-projectile charge is rigidly attached to said fuselage.

11. A method for defeating a short-range surface-to-surface projectile, the method comprising the steps of:

(a) estimating a trajectory of the projectile;

(b) firing a projectile-intercepting munition on an intercepting flight path so as to bring the projectile-intercepting munition within an engagement distance from the projectile, the projectile intercepting munition comprising a fuselage having an axis and carrying a warhead system including a charge; and (c) detonating said charge so as to defeat the projectile, wherein said charge is an explosively-formed-projectile charge having a length and configured to generate at least one explosively formed blade projectile propagating substantially perpendicular to said length, said explosively-formed-projectile charge assuming a deployed state in which said length is non-parallel to said axis.

12. The method of claim 11, wherein said explosively-formed-projectile charge is configured to generate at least two explosively formed blade projectile propagating substantially perpendicular to said length.

13. The method of claim 11, wherein said deployed state and said explosively-formed-projectile charge are configured such that, when said explosively-formed-projectile charge is detonated in said deployed state, said explosively formed blade projectile propagates in a direction non-coplanar with said length of said explosively-formed-projectile charge and said axis of said fuselage.

14. The method of claim 11, wherein said deployed state and said explosively-formed-projectile charge are configured such that, when said explosively-formed-projectile charge is detonated in said deployed state, said explosively formed blade projectile propagates in a direction forming an angle of between 80 degrees and 180 degrees with a forward direction of said fuselage along said axis.

15. The method of claim 11, wherein said warhead system includes at least a first and a second explosively-formed-projectile charge, and wherein said warhead system is configured to allow selective detonation of a first of said explosively-formed-projectile charges without detonation of a second of said explosively-formed-projectile charges.

16. The method of claim 11, wherein said projectile-intercepting munition further including a deployment mechanism configured to allow selective deployment of said explosively-formed-projectile charge to a deployed position at each of a plurality of different angles relative to said axis, the method further comprising activating said deployment mechanism so as to deploy said explosively-formed-projectile charge for directing said explosively formed blade projectile towards the projectile.

* * * * *